United States Patent [19]

Kirk et al.

[11] Patent Number: 4,688,694

[45] Date of Patent: Aug. 25, 1987

[54] SAFETY MEANS FOR PRESSURIZED GAS CONTAINERS

[75] Inventors: Kenneth L. Kirk, Cranston; Robert F. O'Connor, Greenville, both of R.I.

[73] Assignee: Amtrol Inc., West Warwick, R.I.

[21] Appl. No.: 819,386

[22] Filed: Jan. 16, 1986

[51] Int. Cl.[4] ..... B65D 25/00

[52] U.S. Cl. ..... 220/89 A; 220/89 B; 220/3

[58] Field of Search ..... 220/89 A, 89 B, 3, 365; 137/71, 587

[56] References Cited

U.S. PATENT DOCUMENTS

| | | | |
|---|---|---|---|
| 2,576,431 | 11/1951 | White | 220/89 A |
| 2,743,036 | 4/1956 | Wachtell | 220/89 B |
| 2,915,216 | 12/1959 | Coffman | 220/89 A |
| 3,080,091 | 3/1963 | Philip | 220/89 A |
| 3,283,960 | 11/1966 | Williams | 220/89 A |
| 4,006,838 | 2/1977 | Baumann et al. | 220/3 |
| 4,236,648 | 12/1980 | Wood et al. | 220/89 A |
| 4,416,388 | 11/1983 | Mulawski | 220/89 A X |

*Primary Examiner*—Steven M. Pollard
*Attorney, Agent, or Firm*—Fisher, Christen & Sabol

[57] ABSTRACT

A container for pressurized gas, having a valve for filling and emptying the container, a frangible safety relief cup located near the valve and a deflector plate attached to the bottom portion of the valve. The safety relief cup is frangible so that the safety relief cup will rupture if the container is filled to too high of a gas pressure. The problem with such safety feature is that upon rupture the escaping gas often travels in an upwards direction at a very high speed, allowing the discharging contents to spray on the face or upper torso by the person causing injury to the face of refrigerant frost bite or the like. The deflector plate is wide enough and extends far enough over top of the frangible safety relief cup to prevent the upwards flow of the escaping pressurized gas from the ruptured safety relief device. Also, if the safety relief cup itself breaks lose due to gas pressure in the container, the deflector plate protects the person standing above the container from being hit in the face or upper torso by the flying safety relief device.

29 Claims, 5 Drawing Figures

SAFETY MEANS FOR PRESSURIZED GAS CONTAINERS

BACKGROUND OF THE INVENTION

1. Field of the Invention

The invention relates to containers for pressurized gas, which each has a valve for filling and emptying and safety relief means, such as, a frangible safety relief device.

2. Prior Art

Containers for pressurized gas have long had safety relief means in order that the pressure in the container not become so great (say, during filling) as to present a problem of the tank exploding. A typical safety relief means is a frangible safety relief device located in a port in the container. The safety relief device is welded around its perimeter to the tank. The cup-shaped relief means typically has a hemispherical bottom protruding into the cup. When the pressure in the tank exceeds a predetermined level such as when someone filling the tank tries deliberately to or inadvertently places too much gas into the tank, the hemispherical portion of the frangible cup-sahped safety means ruptures. The result is that the gas escapes from the container through the rupture at a very rapid velocity. The result sometimes injures the person filling or using the tank by the high velocity escaping gas, hitting them in the face or upper torso. Usually the safety release means is located in the top portion of the pressurized gas container in close proximity to the valve used for filling and emptying the container. The location of the safety relief device near the valve makes it all the more dangerous when the safety relief device ruptures to relieve gas pressure in the container since that means that the direction of the escaping gas is upwards. Also, sometimes the pressure may cause the weld seal around the perimeter of the safety relief device to totally break, hurling the separated relief device itself upwards at the person.

While the frangible safety relief device is an important safety feature, its very mechanism sometimes causes a safety problem to those who use and fill such containers. The art has recognized the need to solve the safety problem present by the frangible safety cup means, but has been unable to provide a simple, effective and inexpensive solution thereto.

BROAD DESCRIPTION OF THE INVENTION

An object of the invention is to provide a simple, effective and inexpensive solution to the above-noted safety problem. Other objects and advantages of the invention are set out herein or are obvious herefrom to one skilled in the art.

The objects and advantages are achieved by the safety means and combination of the invention.

The invention involves a combination which includes a container, such as, a cylinder, for pressurized fluid which has two ports in the wall thereof. The ports are located in close proximity to each other. A valve for filling and emptying the container is mounted in the first port of the container. Safety relief means is located over top of the second port. Deflector means is positioned over at least a portion of the safety relief means in a non-contacting manner therewith so as to be in the proximity of the safety relief means. The deflector means is preferably a flat plate, that is, at least that portion thereof which extends over the safety relief means is preferably a flat plate.

The safety relief device is frangible so that the safety relief device will rupture if the container is filled to too high of a gas pressure. The problem with such safety feature is that upon rupture the escaping gas often travels in an upward direction at a very high speed, impinging on the head or upper torso of the person filling or emptying the container. Often refrigerant frost bite is encountered. The deflector plate is wide enough and extends far enough over top of the frangible safety relief device to prevent the upward flow of the escaping pressurized gas from the ruptured safety relief device. Also, if the safety relief device itself breaks loose from the container, the deflector plate protects the person standing above the container from being hit in the head or upper torso by the device or released contents from the container.

DETAILED DESCRIPTION OF THE INVENTION

Figure 1:
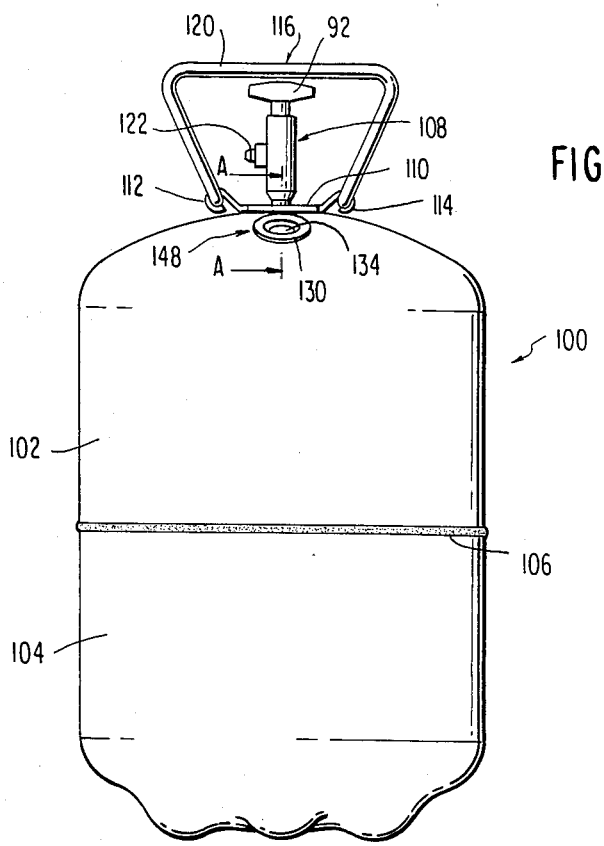
FIG. 1 is a front elevational view of a pressurized gas container having a valve, a safety relief device, a deflector plate, a handle bracket and handles.
Figure 2:
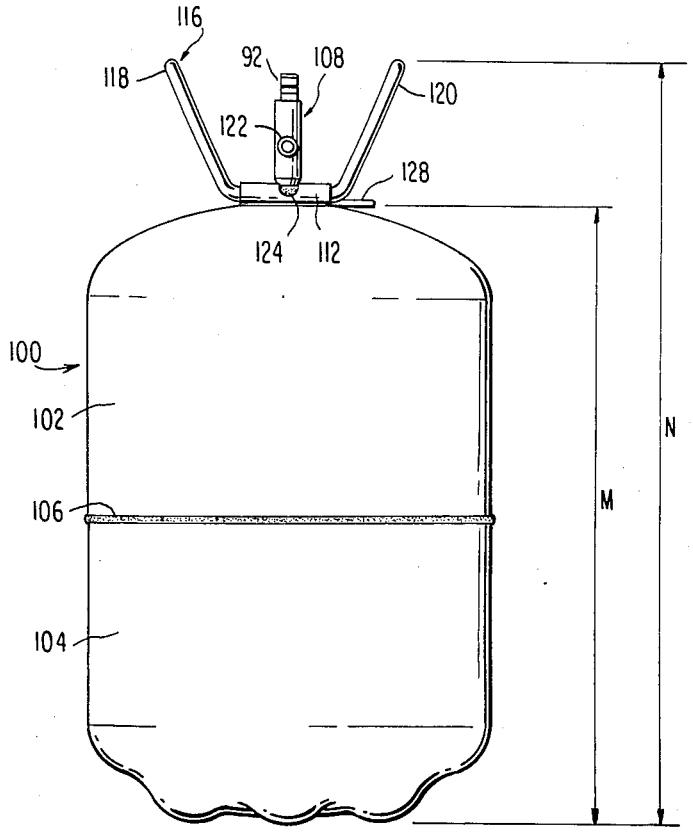
FIG. 2 is a side elevational view of the container of FIG. 1 having the valve, the safety relief device, the deflector plate, the handle bracket and the handles.
Figure 5:
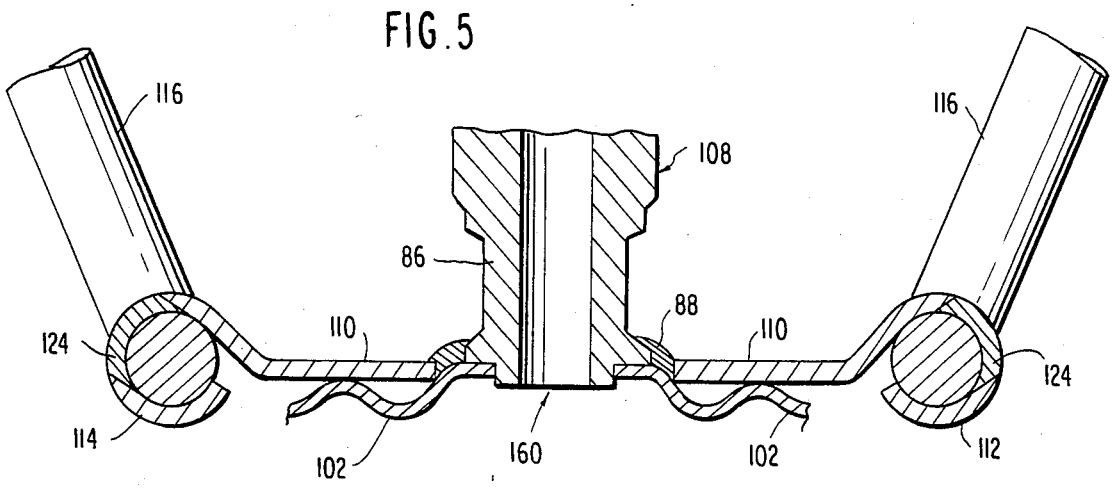
FIG. 5 is a cross-sectional view of one embodiment of the attached deflector bracket plate on the lower portion of the valve.

In FIG. 1, container 100 (a cylinder) for pressurized gas is composed of upper tank portion 102 and lower tank portion 104 which are welded together along seam 106. Container 100 is typically a cylinder having a container capacity of 740 cubic inches (12,129 $cm^3$), a height (M) of $13\frac{1}{4}$ inches (336.55 mm), an internal diameter (P) of 9 inches (228.60 mm), a water capacity of 26.7 pounds (12.11 kg), a test pressure of 325 p.s.i. (22.4 bar), and a maximum burst pressure of 650 p.s.i. (44.8 bar). The lower end of housing 86 of valve 108 is mounted in port hole 160 (see FIG. 5) in the top of segment 102 and allows the filling and emptying of container 100 with pressurized gas. Valve 108 has filling port 122 and knob 92. Valve 108 preferably is a non-refillable valve of the type described in commonly-assigned U.S. patent application Ser. No. 619,503, filed on June 11, 1985, the pertinent portions of said application, including the drawings thereof, being incorporated therein by reference. The bottom portion (86) of valve 108 is circular in lateral cross-section and port 160 is also circular in cross-section. Deflector bracket plate 110 contains a central hole therein through which the end of housing 86 of valve 108 fits with sufficient space to allow the MIG welding of deflector bracket plate 110 and the end of valve housing 86 to dome 102 of container 100. FIG. 5 shows the attaching of deflector bracket plate 110 attached to valve housing 86 to container 100 with the end of valve housing 86 mounted in port 160 of upper tank 102.

Figure 4:
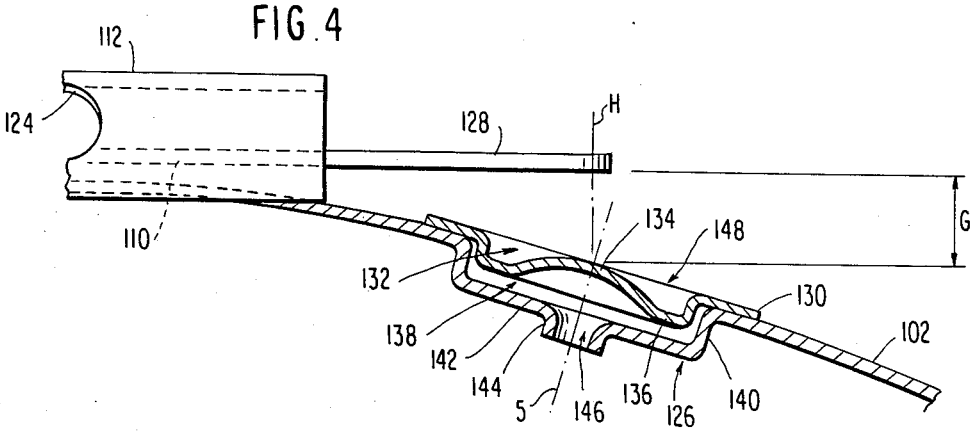
FIG. 4 is a partially cut-away view of the top portion of the container of FIG. 1 along line A—A in FIG. 1, showing the safety relief cup in cross-section and the deflector bracket including handle mount and deflector plate portion.

Each side of deflector bracket plate 110 has a side portion which is rolled into a c-shaped cross-section that accepts also lower portions of handle unit 116 and also. The orientation of valve 108 is such that the nozzle 122 is perpendicular to 112 and 114 of deflector bracket plate 110. As shown in FIG. 4, for C-unit 112 (with the same being the case for side 114) has a hole 124 provides means for plug welding the bottom arms of handle unit 116 securely in place on side 112 and 114.

Figure 3:
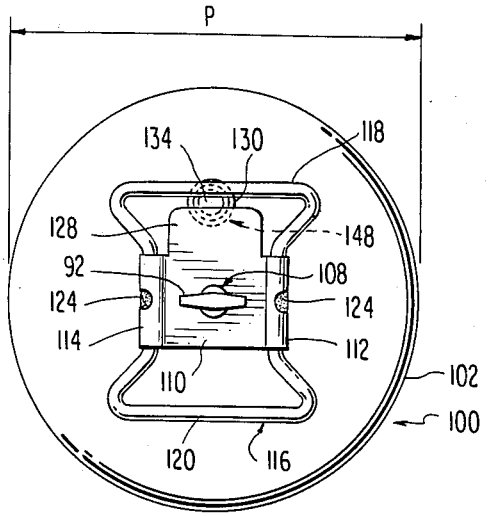
FIG. 3 is a top electional view of the container of FIG. 1 having the valve, the safety relief device, the deflector plate, the handle bracket and the handles.

In close proximity to valve 108 is safety relief unit 148, as shown for example, in FIG. 3. The flat plate 128 of deflector bracket plate 110 extends over a portion of safety relief unit 148, as best shown in FIG. 4. Safety relief unit 148 is comprised of disk 130 and contains central cup-shaped unit portion 132. Safety relief unit 148 has a relief setting suitable for the gaseous product in container 100. The central part 134 of bottom surface 136 of frangible cup-shaped portion 132 is hemispherical and has an outwardly facing hemispherical shape. Disk 130 is located over port 138 in upper portion 112 of container 110. The cup-shaped portion 132 of disk 130 fits within port 138. Port 138 is also cup-shaped having side 140 and bottom portion 142. Short nipple 144 forms aperture 146 in bottom surface 142. Aperture 146 is typically a pierced relief orifice having a diameter suitable to assure proper relief.

The distance (G) between the bottom surface of deflector plate 128 and the plane of the center portion of the top surface of safety release plate 130 is preferably 0.1 inch but should be great enough to allow unrestricted flow during relief. The angle between the bottom surface of the plane of deflector plate 128 and the plane of the top surface of safety release plate 130 is preferably between 10 and 25 degrees, and most preferably is about 15 degrees.

The end of deflector plate 128, which overlies a portion of safety release plate 130, sometimes does not extend past the vertical central axis of safety release plate 130, but the critical factor is that deflector plate 128 be so positioned as not to impede the escaping pressurized gas from ruptured cup-shaped portion 132 while deflecting any escaping pressurized gas that is errantly directed toward the head or upper torso of the user.

Preferably the end of deflector plate 128, which overlies a portion of safety release plate 130, extends far enough over safety release plate 130 so that, when safety release valve 148 ruptures, the escaping pressurized gas cannot travel past deflector plate 128 in a direction which is parallel to or intersects the longitudinal axis of valve 108. Also, preferably the end of deflector plate 128 which overlies a portion of deflector plate 128, is wide enough so that, when 148 safety release valve ruptures, the escaping pressurized gas cannot travel past the side edges at an angle which is less than 40 degrees to the vertical axis (5) of safety release plate 130.

In the most preferred embodiment, axis (H) intersects axis (5).

What is claimed is:

1. In combination, (a) a container for pressurized fluid, container (a) having a first port (b) and a second port (c) in the wall thereof, (d) a valve for filling and emptying container (a), valve (d) being mounted in said first port (b) of container (a), (e) safety relief means located in said second port (c), and (f) deflector means which is attached to valve (d) or to the top of container (a) near said first port (b) and which is positioned over at least a portion of safety relief means (e) in a non-contacting manner therewith so as to be in the proximity of safety relief means (e) without restricting the relief flow, said first port (b) and said second port (c) being located in sufficient proximity to each other so as to allow deflector means (f) to be positioned over said at least a portion of safety relief means (e).

2. The combination as claimed in claim 1 wherein container (a) is for pressurized gas.

3. The combination as claimed in claim 2 wherein deflector means (f) is a deflector plate which is attached on one end to the portion of valve (d) adjacent to container (a) or to the top of container (a) near said first port (b).

4. The combination as claimed in claim 2 wherein deflector means (f) is a deflector plate which is attached on one end to the portion of valve (d) adjacent to container (a).

5. The combination as claimed in claim 4 wherein the other end of said deflector plate overlies at least a portion of safety relief means (e).

6. The combination as claimed in claim 5 wherein safety relief means (e) is a plate which is positioned over said second port (c) and which is sealingly affixed to the wall of container (a) in a manner such that said seal fails when the gas pressure in container (a) exceeds a predetermined level, or which is sealingly affixed to the wall of container (a) and is constructed of a frangible material which ruptures when the gas pressure in container (a) exceeds a predetermined level.

7. The combination as claimed in claim 6 wherein container (a) is a metal tank, said safety relief plate is metal and said metal safety relief plate is welded to the outer surface of said metal tank around the periphery of said second port (c).

8. The combination as claimed in claim 7 wherein said first port (b) is circular in longitudinal cross-section, said first port (b) is circular in longitudinal cross-section and the portion of said deflector plate overlying a portion of said safety relief plate is generally flat.

9. The combination as claimed in claim 8 wherein said safety relief plate is circular in cross-section.

10. The combination as claimed in claim 8 wherein the portion of said safety relief plate overlying said second port (c) protrudes into said second port (c).

11. The combination as claimed in claim 10 wherein said portion of said safety relief plate which protrudes into said second port (c) is shaped like an outwardly-facing cup.

12. The combination as claimed in claim 11 wherein the bottom of said outwardly-facing cup portion of said safety relief place is convexly-shaped in the outwardly-facing direction.

13. The combination as claimed in claim 11 wherein said second port (c) is shaped like an outwardly-facing cup with a centrally-located orifice in the bottom thereof.

14. The combination as claimed in claim 6 wherein the portion of said deflector plate overlying a portion of said safety relief plate is generally flat.

15. The combination as claimed in claim 14 wherein said safety release plate is constructed of a frangible material.

16. The combination as claimed in claim 15 wherein said frangible material is a frangible metal.

17. The combination as claimed in claim 15 wherein the distance between the bottom surface of said deflector plate and the plane of the center portion of the top surface of said safety release plate is sufficient to allow unrestricted flow.

18. The combination as claimed in claim 15 wherein the angle between the plane of the bottom surface of said deflector plate and the plane of the top surface of said safety release plate is between 10 and 25 degrees.

19. The combination as claimed in claim 15 wherein the angle between the plane of the bottom surface of said deflector plate and the plane of the top surface of said safety release plate is about 15 degrees.

20. The combination as claimed in claim 15 wherein the end of said deflector plate, which overlies a portion of said safety release plate, does not extend past the vertical central axis of said safety release plate.

21. The combination as claimed in claim 15 wherein the end of said deflector plate, which overlies a portion of said safety release plate, extends far enough over said safety release plate so that, when said safety release plate ruptures, the escaping pressurized gas cannot travel past the deflector plate in a direction which is parallel to or intersects the longitudinal axis of valve (d).

22. The combination as claimed in claim 15 wherein the end of said deflector plate, which overlies a portion of said deflector plate, is wide enough so that, when safety release valve ruptures, the escaping pressurized gas cannot travel past the side edges at an angle which is less than 40 degrees to the vertical axis of said safety relief plate.

23. The combination as claimed in claim 15 wherein the distance between the bottom surface of said deflector plate and the plane of the center portion of the top surface of said safety release plate is at least 0.1 inch, the angle between the plane of the bottom surface of said deflector plate and the plane of the top surface of said safety release plate is between 10 and 25 degrees, and the end of said deflector plate, which overlies a portion of said safety release plate, does not extend past the vertical central axis of said safety release plate.

24. The combination as claimed in claim 5 wherein safety relief means (e) is a plate which is positioned in said second port (c) and which is sealingly affixed to the inner wall surface of said second port (c) in a manner such that said seal fails when the gas pressure in container (a) exceeds a predetermined level, or which is sealingly affixed to the wall of container (a) and is constructed of a frangible material which ruptures when the gas pressure in container (a) exceeds a predetermined level.

25. The combination as claimed in claim 6 wherein the portion of said safety relief plate overlying said second port (c) protrudes into said second port (c).

26. The combination as claimed in claim 4 wherein said end of said deflector plate attached to valve (d) is generally flat and contains an aperture therein, said aperture fitting around valve (d) and providing means for said attachment of said deflector plate to valve (d).

27. The combination as claimed in claim 26 wherein said aperture is circular in longitudinal cross-section, and the end portion of valve (d) to which said deflector plate is attached is circular in lateral cross-section.

28. The combination as claimed in claim 27 wherein handle means is attached to said end portion of said deflector plate attached to valve (d).

29. The combination as claimed in claim 28 wherein said handle means is two oppositely located handles.

* * * * *